United States Patent [19]

Kobelt

[11] Patent Number: 4,669,264

[45] Date of Patent: Jun. 2, 1987

[54] APPARATUS AND METHOD FOR LOAD CONTROL OF AN ENGINE

[76] Inventor: Jacob Kobelt, 6110 Oak Street, Vancouver, British Columbia, Canada, V6M 2W2

[21] Appl. No.: 769,461

[22] Filed: Aug. 26, 1985

[51] Int. Cl.[4] ..... F16D 31/02

[52] U.S. Cl. ..... 60/388; 60/431; 91/368; 416/49; 416/162

[58] Field of Search ..... 60/431, 388, 392; 91/358 R, 368, 388, 182, 189 R, 519; 92/13.1, 62; 416/49, 43, 38, 162, 27

[56] References Cited

U.S. PATENT DOCUMENTS

| | | | |
|---|---|---|---|
| 2,533,833 | 12/1950 | Mott | 92/13.1 X |
| 2,672,096 | 3/1954 | Kroldrup | 60/388 X |
| 3,719,041 | 3/1973 | Barnard et al. | 92/62 |
| 3,724,970 | 4/1973 | Kobelt | 416/27 |
| 3,805,669 | 4/1974 | Mitchell | 92/13.1 X |
| 3,826,590 | 7/1974 | Kobelt | 416/27 |
| 4,072,087 | 2/1978 | Mueller | 92/13.1 X |
| 4,260,329 | 4/1981 | Bjorknas | 416/43 |
| 4,533,295 | 8/1985 | Duchesneau | 416/49 X |

*Primary Examiner*—Edward K. Look
*Attorney, Agent, or Firm*—Carver & Co.

[57] ABSTRACT

Apparatus is for controlling load on an engine, particularly a marine engine powering a controllable pitch propeller which serves as an engine loading device. Apparatus cooperates with a circuit having a supply fluid at a constant supply pressure, and a control fluid at a variable control pressure reflecting engine load. The apparatus has a signal receiver to receive a load demand signal from an operator, and a positioner apparatus with a positioner output which cooperates with the loading device of the engine. The positioner apparatus receives the supply and control fluids and has a partition separating the fluids to permit interaction therebetween to control the positioner output. The apparatus has a hydraulic fluid valve to control flow of hydraulic fluid relative to the positioner apparatus, the fluid valve being connected to the positioner output and an output of the signal receiver so as to be responsive to relative positions of both outputs. The apparatus provides a relatively simple system using hydraulic fluid for accurate load control which responds quickly to an engine overload occurrence so as to reduce the load on the engine quickly to reduce or prevent engine damage. Complex electronics are not required, permitting servicing by persons familiar with mechanical/hydraulic systems. Furthermore, the device has a fail-safe system which accommodates a complete hydraulic pressure failure without damage to the components. Also, a manual over-ride provision can be incorporated to permit reduction of load manually, without assistance from hydraulic pressure, should hydraulic pressure fail.

23 Claims, 4 Drawing Figures

APPARATUS AND METHOD FOR LOAD CONTROL OF AN ENGINE

BACKGROUND OF THE INVENTION

1. Field of the Invention

The invention relates to an apparatus and method for automatically controlling loads imposed on an engine while operating, and is particulary adapted for, but not limited to, controlling load on an engine powering a controllable pitch propeller as used in marine applications.

2. Prior Art

Apart from light recreational marine craft, most commercial marine power vessels use a governor to control engine speed, and often power a controllable pitch propeller. Engine overloading can still occur due to operator error or adverse weather conditions and automatic load control or overload prevention systems have been designed to reduce loads on the engines. Some prior art load control systems are characterized by a slow response to an overload situation, and sometimes a "hunting" condition can arise between the automatic load control and the pitch control unit so that loading on the engine fluctuates between upper and lower limits producing erratic running of the engine. To the inventor's knowledge, prior art load control devices using pneumatic components have been relatively unsuccessful due to inaccuracy of control. Hydraulic devices have been characterized by slow response, and often exhibit hunting tendencies. While electronic devices have been relatively successful, and can be designed for a high degree of accuracy, they are costly and characterized by complex electronics which require servicing by specialised personnel, which are often not easily available on a marine vessel. Also, it can be difficult to protect sensitive electronic components from the harsh environment of marine vessels. Consequently, marine load control devices using complex electronics can be difficult to maintain, and when failure occurs, inexperienced on-board personnel can have difficulty in solving maintenance problems in isolated situations which can occur at sea.

SUMMARY OF THE INVENTION

The invention reduces the difficulties and disadvantages of the prior art by providing an apparatus and method which reduces the chances of overloading an engine by using hydraulic fluid as a main control medium operating relatively simple hydraulic components. The system receives a supply of hydraulic fluid under a constant supply pressure, which can be the same supply pressure fed to a hydraulic governor commonly used on marine power plants. Output from most hydraulic governors is a hydraulic fluid pressure signal which, for most loading situations, is less than the original constant supply pressure. The signal from the governor is termed "control pressure" and reflects the engine loading condition and can be easily incorporated into the invention. The invention also has a fail-safe provision so as to accommodate total hydraulic pressure failure without damage to the engine or apparatus components. A manual over-ride arrangement is provided to permit manual reduction of the load should hydraulic pressure fail. For a controllable pitch propeller system, load is usually automatically reduced by making the propeller pitch finer.

An apparatus according to the invention is for controlling a load imposed on an engine and cooperates with a fluid circuit receiving hydraulic supply fluid at an essentially constant supply pressure and hydraulic control fluid at a variable control pressure reflecting engine load. The apparatus includes a signal receiving means, a positioner apparatus and a hydraulic fluid valve means. The signal receiving means has a signal input means to receive a load demand signal from an operator, and a signal output means. The positioner apparatus has a positioner input means to receive the supply and control fluids, and a positioner output means adapted to cooperate with the loading means of the engine. The positioner apparatus has partition means separating the supply and control fluids the partition means having a plurality of partitions having faces and being movable relative to each other, the faces being exposed to the supply and control fluids. In an engine overload condition, forces generated on the faces act in opposition to each other to produce relative movement between the partition means to control the positioner output means. The hydraulic fluid valve means controls flow of hydraulic fluid relative to the positioner apparatus and cooperates with the positioner output means and the signal output means so as to be responsive to relative positions of both said output means.

One example of the positioner apparatus according to the invention has a positioner cylinder body having two spaced supply fluid chambers, each supply fluid chamber having a respective supply fluid port to receive and discharge supply fluid. The body also has two spaced control fluid chambers, each control fluid chamber having a respective control fluid port to receive and discharge control fluid. The partition means are reciprocable relative to the body and have two oppositely facing supply faces of equal effective area to each other, in which each supply face is exposed to fluid in a respective supply fluid chamber. The partition means also has two oppositely facing control faces of equal effective area to each other, in which the control faces are exposed to fluid in a respective control fluid chamber. The positioner output means reflects position of the partition means within the positioner cylinder means while cooperating with the loading means of the engine.

A method according to the invention controls load on an engine in which the loaded engine generates a load output signal. The load output signal is a first hydraulic control fluid at a variable control pressure reflecting the engine load. The method is characterised by providing a second hydraulic fluid at a constant supply pressure, receiving a load demand signal from an operator and actuating a fluid control valve in response to the load demand signal to direct one of the hydraulic fluids relative to a positioning apparatus. The method includes admitting into the positioning apparatus the remaining fluid and and providing in the positioner apparatus moveable partitions having at least two oppositely facing faces to separate the fluids, but permitting interaction therebetween to generate a positioner output signal. The output signal is transmitted simultaneously to means controlling load on the engine and to the control fluid valve to reflect disposition of means controlling the load on the engine.

A detailed disclosure following, related to drawings, describes preferred apparatus and method according to the invention, which however are capable of expression in apparatus and method other than those particularly described and illustrated.

DETAILED DISCLOSURE

Figure 1:
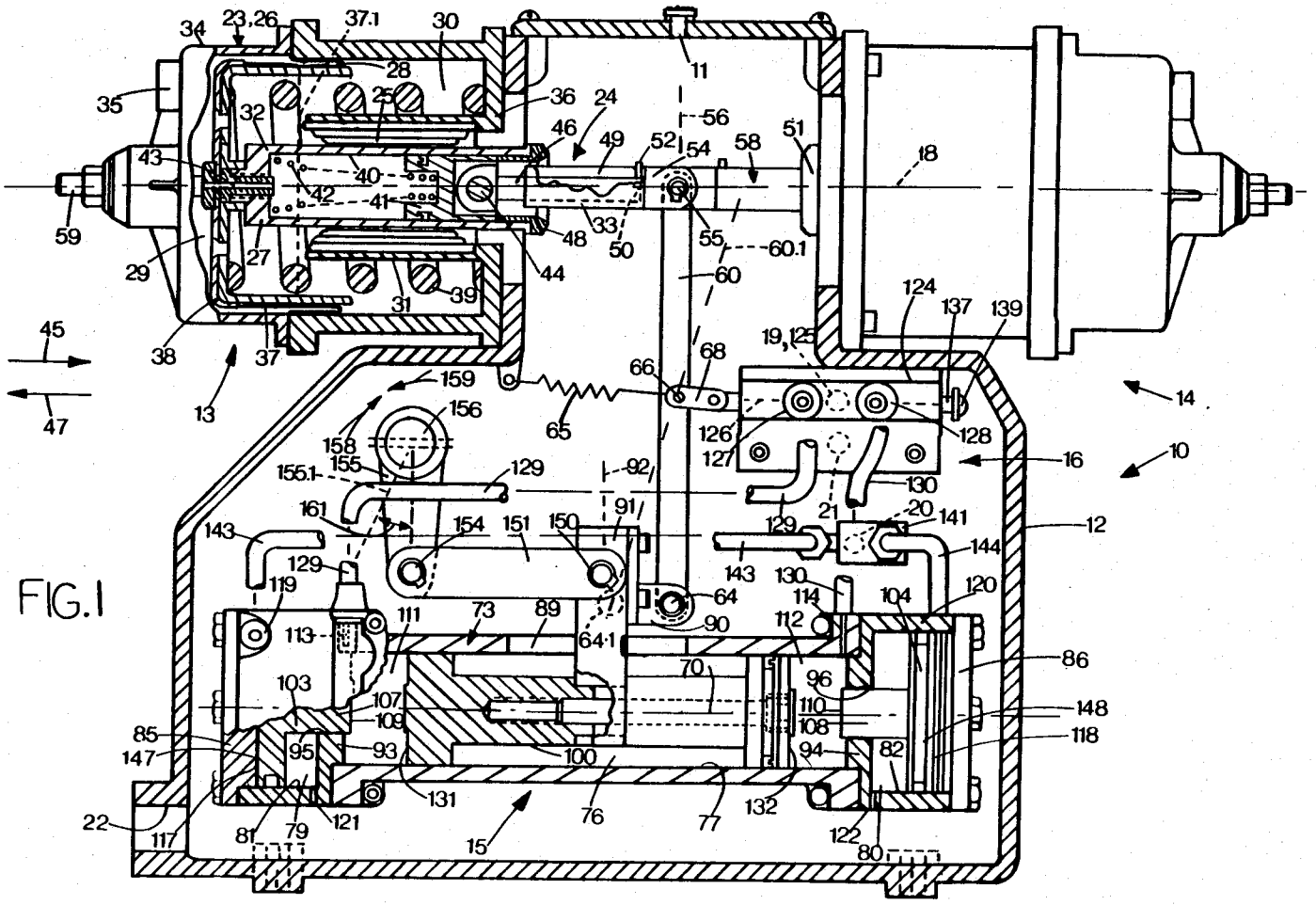
FIG. 1 is a simplified, fragmented front elevation of a load control apparatus according to the invention, with some portions removed to show internal detail, the apparatus being shown in full outline in neutral pitch condition, some portions of the apparatus also being shown in broken outline to reflect a full ahead demand signal and output position, with no overload compensation.
Figure 2:
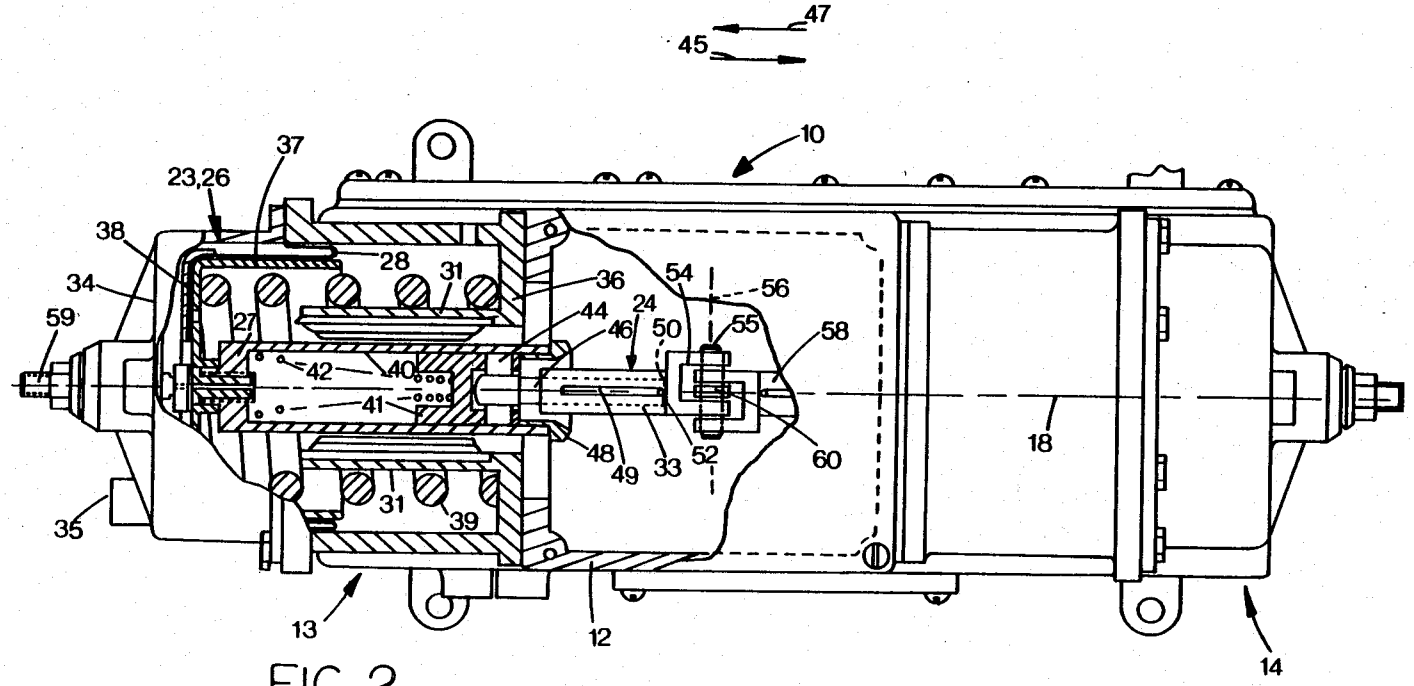
FIG. 2 is a simplified, fragmented top plan of FIG. 1, with some portions being removed for clarity, the apparatus being shown in full outline in a neutral pitch condition.
Figure 3:
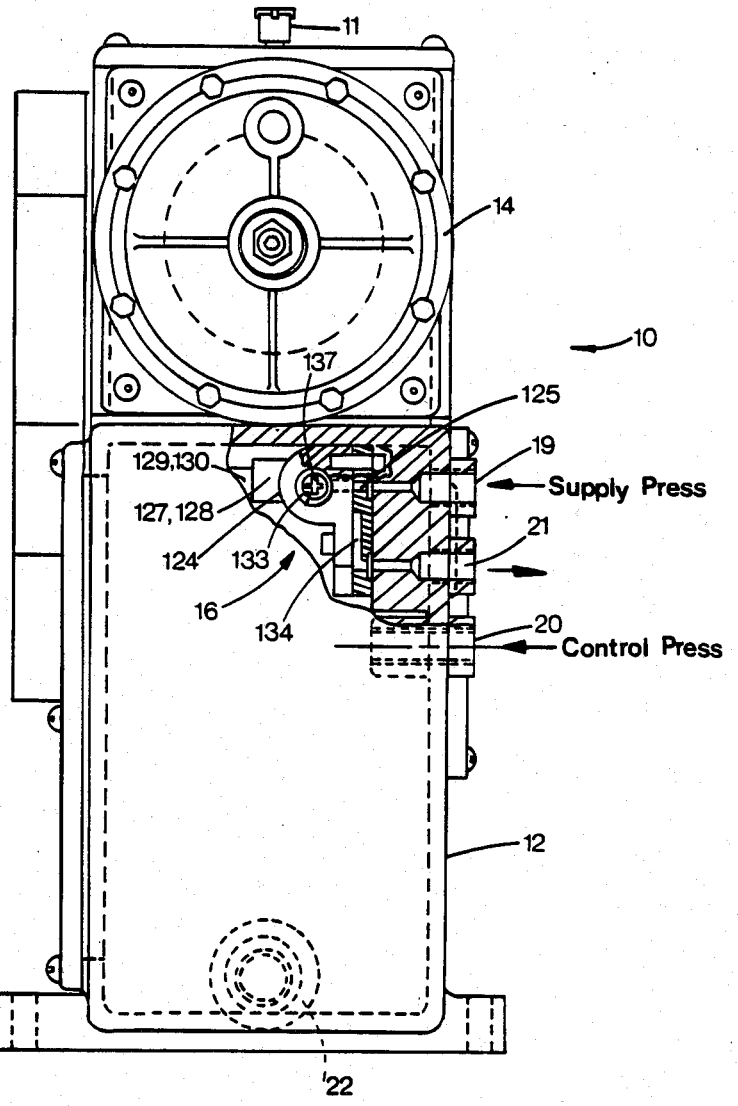
FIG. 3 is a simplified, fragmented end elevation of FIG. 1, with some portions being removed to show internal detail.

FIGS. 1 through 3

Referring mainly to FIG. 1, a load control apparatus 10 according to the invention is shown within a casing 12 and includes a forward pitch signal receiving means 13, and a reverse pitch signal receiving means 14. The signal receiving means receive pneumatic signals from a control head, not shown, manipulated by an operator, the control head generating a pitch signal alone, or in combination with a throttle signal. When the pitch signal is neutral, a throttle signal, not shown, is usually at idle. The apparatus also includes a positioner apparatus 15 and a hydraulic fluid valve means 16. The apparatus cooperates with a fluid circuit, not shown, and receives a supply fluid at an essentially constant supply pressure through a main supply fluid input port 19, best seen in FIG. 3. The apparatus also receives from the circuit a control fluid through a main control fluid input port 20, see FIG. 3, the control fluid being at a variable control pressure reflecting engine load. The control fluid is preferably supplied from an output of an engine speed governor, such as a Woodward's PGA type governor, so that the control fluid pressure directly reflects engine load. This type of governor is manufactured by the Woodward Governor Company of Ft. Collins, Colo., U.S.A. The control fluid signal is termed control pressure, and is at a minimum when the engine is at idle, and a maximum when the engine is severely overloaded such that maximum control pressure can equal supply pressure. Characteristics of the output from such a governor or equivalents are well known, and intermediate stages of engine loading from idle to full overload condition provide corresponding increases in control pressure. The apparatus also has a fluid return port 21, best seen in FIG. 3, which returns fluid from the apparatus to the sump when the apparatus receives a fluid flow. A low pressure scavenge port 22 is at a low point in the casing for draining minor fluid accumulations, and a vent 11 in the casing vents any accumulation of air.

The signal receiving means 13 and 14 are aligned about a common axis 18 and are spaced apart oppositely to each other. Internal structure of the two devices is essentially the same, and thus only the forward pitch signal receiving means will be described in detail at this time. The signal receiving means 13 is basically a diaphragm actuator 23 with a resilient output rod assembly 24. The actuator has a hollow body 26 containing a resilient impermeable diaphragm 28 which is shown folded in the retracted position and divides the body into an input chamber 29 and a spring chamber 30. The output rod assembly 24 has first and second output rods 32 and 33, the rods being telescopically mounted relative to each other with the second rod 33 being accepted within the first rod 32 as will be described. The body 26 includes an outer end cap 34 with an input port 35 at one end to receive the forward pitch signal. The body 26 has an inner end 36 carrying an inner sleeve 31 surrounding a clearance opening to receive the output rod assembly, the inner end 36 being secured to the casing 12. The output rod 32 is mounted on a low friction ball bearing 25 within the sleeve 31 to reduce resistance to axial sliding. The output rod 32 has an end portion 27 which carries a plunger 37 and a diaphragm retainer 38, the diaphragm 28 being sandwiched between the plunger and retainer. A compression helical coil spring 39 extends between the plunger 37 and the inner end 36 and tends to force the diaphragm into the input chamber 29, concurrently withdrawing the output rod 32 in direction of an arrow 47. Clearly, application of a fluid pressure demand signal at the port 35 acts on the diaphragm 28 and the plunger 37, tending to compress the spring 39 and extend the rod 32 into the casing 12 in direction of an arrow 45.

The first output rod 32 is hollow and has a main inner bore 40, and a smaller equalising bore 43 extending through the end portion 27 to communicate the input chamber 29 with the main inner bore 40 so that the bore 40 is exposed to the same pressure as the chamber 29. A piston 41 is a sliding fit within the bore 40, and a conical compression spring 42 extends between the end portion 27 of the rod 32 and the piston 41, the spring 42 tending to force the piston 41 inwardly into the casing 12. An adjustable stop sleeve 48 is screw-threaded onto an inner end of the rod 32 and limits inward movement of the piston 41 relative to the rod 32. Positions of the sleeve 48 and a corresponding sleeve 51 of the signal receiving means 14 are finely adjusted to eliminate essentially undesirable lost motion between the output rods of the two signal receiving means 13 and 14.

As also seen in FIG. 2, the piston 41 carries a transversely disposed piston pin 44 which journals a connecting rod 46 generally aligned with the axis 18. The second output rod 33 has an axial bore to receive the connecting rod 46 as a sliding fit therein, so that the rod 33 is effectively journalled on the piston 41 to permit rotational movement about the pin, and axial movement relative to the pin. Inwards axial movement of the piston per arrow 45 is also transferred to the rod 33 because the rod 46 has an end 50 which contacts a blind end of the axial bore of the rod 33 in the fully retracted position as shown. The rod 33 has an elongated axial slot 49 aligned with the axis 18 when seen in FIG. 2, and the connecting rod 46 has an outer end having a sliding pin 52 extending outwardly therefrom. The pin 52 is a sliding fit within the axial slot 49 and limits relative rotational movement between the connecting rod 46 and the second output rod 33.

It is seen that, in effect, the output rod assembly 24 has three telescopically mounted rods 32, 33 and 46, but for slowly applied signal changes involving no overload compensation, the rods 32, 33 and 46 function generally as a single rod with the piston 41 moving essentially concurrently with the rod 32, and the rod 46 being held against an inner end of the bore of the rod 33 due to force from air pressure in the bore 40 and from the spring 42 as shown. The spring 42, in combination with the air pressure, provides a resilient interconnection cooperating with the two output rods to apply an axial force thereto, and prevents damage to the apparatus in certain circumstances. The output rod 33 has a bifurcated end 54 remote from the pin 44 carrying a connecting pin 55. As best seen in FIG. 2, a similar resilient output rod assembly 58 of the actuator 14 is similarly bifurcated and cooperates with the pin 55 in a similar manner. When in neutral as shown in full outline, the pin 55 is adjacent a central position or signal datum 56, which position is attained by fine adjustment of respective adjustable stop sleeves, e.g. 48, to limit outward movement of the respective rods. Also, for initial set-up procedure only, a set screw 59 in the end cap 34 cooperates with the end portion 27 to permit pre-loading of the spring 39 for zero pitch setting.

A rigid coupling link 60 has an upper end connected to the pin 55 and a lower end connected to a positioner pin 64, the pin 64 connecting the link 60 to the positioner apparatus 15. A valve pin 66 cooperates with an intermediate portion of the link 60 and a connecting link 68 to couple the valve means 16 to the link. A tension spring 65 extending between the pin 66 and the casing 12 can be used if necessary to reduce effects of any lost motion associated with the links and pins.

The positioner apparatus has a positioner axis 70 which is disposed parallel to the signal axis 18 and has a positioner cylinder body 73 disposed generally symmetrically about the axis 70. The body 73 has an inner cylinder 76 with an inner bore 77, and first and second spaced apart outer cylinders 79 and 80 at opposite ends of, and aligned with the inner cylinder. The first and second outer cylinders 79 and 80 have respective first and second outer bores 81 and 82 which are larger than the inner bore and closed at respective outer ends by first and second end caps 85 and 86. The positioner cylinder body is fixed relative to the casing and has an axially aligned clearance opening 89 to receive a positioner output arm 91 which extends through the slot, and the slot permits axial movement of the output arm. The arm 91 is shown in a central position at a positioner datum 92 for a minimum load condition, and has a bracket 90 to carry the positioner pin 64. The body 73 of the positioner apparatus also includes first and second dividing walls 93 and 94 located at outer ends of the inner cylinder 76 to divide respective outer cylinders from adjacent respective ends of the inner cylinder, the walls having respective first and second dividing openings 95 and 96 therein.

The positioner apparatus includes an inner partition or double-acting piston 100 mounted for reciprocable movement in the inner cylinder 76, and sealed with undesignated piston cup seals as shown. The inner partition carries the positioner output arm 91 extending perpendicularly therefrom through the clearance opening 89, so as to reflect reciprocable movement of the partition 100 within the inner cylinder. The positioner apparatus also includes first and second outer partitions or overload pistons 103 and 104 mounted for reciprocable movement within the respective outer cylinders 79 and 80. The outer partitions are provided on opposite sides of the inner partition and adapted to cooperate with the inner partition as follows. The outer partitions or overload pistons 103 and 104 have respective inwardly facing, axially aligned first and second projections 107 and 108 which are a sliding sealed fit within the respective dividing opening 95 and 96 in the respective dividing wall 93 and 94. The projections are adapted to contact an end of the inner partition or double-acting piston 100 when the outer partitions are extended inwardly and the inner partition approaches an extreme outer position within the inner chamber. This relationship is so that inward axial movement of the outer partition moves the inner partition to reflect at least a portion of inward movement of the said particular outer partition, or limits movement of the inner partition as will be described. The projections 107 and 108 have respective inner end faces 109 and 110 having areas which are relatively small when compared with the cross-sectional area of the bores of the inner and outer cylinders.

The inner partition or piston 100 cooperates with the inner cylinder 76 to provide first and second inner chambers 111 and 112 positioned between outer ends of the inner partition and the first and second outer partitions respectively. The inner chambers 111 and 112 have first and second supply fluid ports 113 and 114 respectively to receive and discharge supply fluid as will be described. The outer partitions or pistons 103 and 104 cooperate with respective outer cylinders to define first and second outer chambers 117 and 118 positioned between the respective outer partition and the outer end caps 85 and 86 of the respective outer cylinder, the partitions and end caps being shown in their closest proximity, i.e., for minimum volume of outer chambers. The outer chambers 117 and 118 have respective first and second control fluid ports 119 and 120 adapted to receive and discharge control fluid as will be described. The first and second outer chambers 117 and 118 also have first and second bleed ports 121 and 122 respectively which cooperate with a space between the dividing walls 93 and 94 and respective outer partition means. The bleed ports permit drainage of any fluid leakage past the seals of the inner or outer partitions, and prevent fluid build-up which might otherwise inhibit axial movement of the partition means.

The fluid valve means 16 has a valve body 124 which is fixed relative to the casing 12 and has a valve axis 126 parallel to the axes 18 and 70. The body 124 has a valve input port 125 communicating with the input port 19, FIG. 3, to receive the supply fluid. The body 124 also has first and second valve ports 127 and 128 communicating with first and second supply conduits 129 and 130 which cooperate with the first and second supply fluid ports 113 and 114 respectively of the positioner apparatus. Thus the first and second inner chambers 111 and 112 receive constant supply pressure from the supply conduits 129 and 130 respectively, as determined by the valve 16, which pressure acts on first and second end faces 131 and 132 of the inner partition 100, which faces are also termed "supply faces". As best seen in FIG. 3, the valve body has a spool bore 133 communicating with the ports 125, 127 and 128 and a return port 134 which communicates with the return port 21 to return fluid to the sump, not shown. A valve spool 137 is mounted for axial movement within the spool bore to direct fluid relative to the ports 125, 127, 128 and 130 as will be described. The spool 137 is connected to the connecting link 68 and follows movement of the coupling link 60 at the pin 66. An opposite end of the spool has a stop 139 which limits axial movement of the spool in direction of the arrow 47, and interference between the link 68 and the valve body limits movement of the spool in the opposite direction. The valve 16 has a closed centre position and has one position on each side of centre which interchanges the ports 127 and 128 with the ports 125 and 134. Also the valve 16 is a four-way negative lash spool valve characterised by extremely high valve sensitivity such that movement of the valve spool a small distance in the order of 0.1 millimetres is sufficient to interchange conduits in the valve. This valve is selected for a fast response from a small valve spool movement, and commonly there is a small continuous leakage of flow through the valve, which can be tolerated and is typical of a valve of this type. This relatively small flow flows through the port 21 to the sump and does not affect the accuracy of the invention unduly. Thus the valve spool is a movable valve member mounted for axial movement parallel to axial movement of the signal output means, and also parallel to movement of the positioning means.

In summary the spool bore 133 communicates with the valve input port 125 to receive supply fluid, and with first and second ports 127 and 128 to discharge and receive supply fluid as required, and with the exhaust valve port 134 to discharge the supply fluid. The valve member or spool 137 is mounted for movement relative to the valve body so as to direct supply fluid to the respective inner chamber of the positioning means as required.

The main control fluid input port 20 supplies fluid to a conduit union 141 which communicates with first and second control fluid conduits 143 and 144 which in turn communicate with the first and second control fluid ports 119 and 120 respectively of the positioner apparatus. Thus, fluid at the variable control pressure reflecting governor output, and thus engine load, is fed simultaneously to the first and second outer chambers 117 and 118. This control pressure acts against first and second outer faces 147 and 148, which are also termed "control faces", of the first and second outer partitions. There is a predetermined ratio between effective areas of the supply faces and the control faces which determine the ratio of the constant supply pressure to a particular control pressure at a desired engine load as follows. When an engine is operating at a desired or design load condition for a particular engine speed, the governor generates a particular control pressure, which can be termed "equilibrium pressure". The ratio of supply pressure to equilibrium pressure is equal to ratio of the area of one control face to area of one supply face i.e., ratio of the outer bore to the inner bore. This is so that force of the supply fluid at supply pressure acting on one supply face, i.e., acting on the inner partition or double-acting piston 100, can be balanced by force of the control fluid at equilibrium pressure acting on one control face, i.e., acting on one of the outer partitions or overload pistons 103 and 104. This is discussed in the operation of the apparatus.

The positioner output arm 91 has the bracket 90 carrying the positioner pin 64 cooperating with the coupling link 60, and also has a loading pin 150 coupled to a loading link 151. The loading link 151 is coupled by an arm pin 154 to a loading arm 155 which extends rigidly from a loading shaft 156. The loading shaft 156 is typically a pitch controlling shaft which cooperates with a controllable pitch propeller, not shown, so as to vary pitch of the propeller as the shaft 156 is rotated about its axis. Movement of the arm 151 in direction of the arrow 47 rotates the shaft 156 in direction of an arrow 158 to increase forward pitch, and opposite movement of the arm rotates the shaft per arrow 159. Clearly, other engine loading means can be substituted for the controllable pitch properller, so as to vary load on the engine.

OPERATION

As previously stated, the main supply fluid input port 19 receives hydraulic fluid at a constant supply pressure from a conventional hydraulic pump, not shown, and the control fluid input port 20 receives hydraulic fluid under a varying control pressure which reflects engine load. The fluid at control pressure can be supplied from an output of a governor which is normally used to control position of the fuel rack of a diesel engine to control fuel supply to an engine. Other means to generate a hydraulic fluid signal reflecting engine load can be substituted.

FIG. 1 shows in full outline the components of the apparatus when the pitch signal is neutral, i.e., there is neither a forward pitch nor a reverse pitch signal applied to the signal input means. In this neutral condition the connecting pin 55 is at the signal datum 56 and the positioner output arm 91 is similarly at the positioner datum 92, which produces a zero or neutral pitch for the loading shaft 156. The valve means 16 is centred and closes the requisite ports, thus locking fluid within the chambers 111 and 112.

The first and second outer partitions or overload pistons 103 and 104 have their respective control faces 147 and 148 exposed to the relatively low control pressure in the respective outer chambers 117 and 118, due to the engine being at idle. This control pressure generates an inwards force on each outer partition, which is overcome by the constant higher supply pressure acting on the inner end faces 109 and 110 of the respective projections 107 and 108. As previously stated, the area ratio of the inner end face of a projection to the control face is such that constant supply pressure in the inner chambers acting on the projection end face can overcome force from the control fluid within the outer chambers when the engine is at idle, and the outer partitions do not move. When the valve means 16 is centred, the ports 127 and 128 are closed thus sealing the cylinders 111 and 112. The inner partition is clearly hydraulically locked and does not move.

From this neutral pitch, idle condition, the operator demands full ahead, i.e. full forward pitch at full throttle, but this demand signal is applied relatively slowly to the input port 35 of the forward pitch signal receiving means 13, and to the throttle, not shown. Air pressure in the input chamber 29 thus increases slowly to a maximum pressure, moving the plunger 37 in direction of the arrow 45. Simultaneously, air from the chamber 29 passes through the equaliser bore 43 and acts on the piston 41 which also responds to force from the spring 42, causing the piston 41 to move simultaneously in the direction of the arrow 45. The initial movement of the piston 41 shifts the connecting rod 46 in the same direction, and because the end 50 of the rod 46 is at the blind end of the bore of rod 33, there is negligible lost motion and the connecting pin 55 is similarly shifted a small amount. This movement is sufficient to swing the coupling link 60 a corresponding amount, which shifts the spool 137 of the valve 16 also in direction of the arrow 45. This spool movement opens the port 128 to the full supply pressure, which is fed through the conduit 130 into the second inner chamber 112 which applies a force on the inner partition or piston 100 in direction of the arrow 47. The port 127 is connected to the exhaust port 134 so that fluid can be displaced from the chamber 111 to the return port 21 when the inner partition moves a small amount in direction of the arrow 47. This partition movement causes a corresponding rotation of the shaft 156 in direction of the arrow 158 which increases pitch of the propeller, and thus load on the engine. Movement of the positioner output arm 91 in direction of the arrow 47 moves the pin 64, which correspondingly rotates the coupling link 60 in direction of the arrow 158, which correspondingly tends to draw the spool 137 outwardly, tending to close the ports recently opened. The above takes place in a short period of time, and during that time the plunger 37 and piston 41 have moved slightly further inwards in direction of the arrow 45, thus correspondingly rotating the coupling link 60 which again moves the spool 137 inwards per arrow 45, which is in an opposite direction to that movement occurring when the pin 64 moves in direction of the arrow 47. If the piston 41 is restrained against inward movement by the pin 55, such that the plunger 37 moves inwardly faster than the piston 41, the spring 42 compresses to accommodate this difference in speed of response. In effect, there is a sequence of small oscillatory movements of the spool 137 as it is subjected to a general rotation of the coupling link 60 in direction of the arrow 158, which follows movement of the connecting rod 46 in direction of the arrow 45, and this causes movement of the positioner output arm 91 in direction of the arrow 47. The piston pin 44 permits the connecting rod 46, and with it the second output rod 33, to swing slightly laterally from the axis 18 to accommodate swinging of the rigid coupling link 60. The sliding pin 52 in the axial slot 49 prevents relative rotation between the rods 33 and 46, so that the pins 44 and 55 are maintained parallel to each other and binding between the rods is eliminated.

The above sequence of relatively slow movements of the components continues until the centre portion of the plunger 37 attains a full forward pitch position by interfering with an end face of the inner sleeve 31, where the plunger is shown in broken outline at 37.1. This represents a full ahead pitch signal, and the coupling link 60 attains a maximum deflected position 60.1, shown in broken outline. In the full forward pitch condition, the pin 55 is displaced towards the means 14, which causes the output rod assembly 58 to collapse into the means 14 as there is no signal pressure to resist this collapse. This contrasts with the rod assembly 24 which extends from the means 13. In this condition, the pin 64 has assumed a maximum forward pitch position, shown at 64.1, where a centre line of the loading arm 155 has swung through an angle 161 to a position 155.1, representing maximum forward pitch. When this position is attained, the spool maintains an equilibrium in which both ports 127 and 128 are closed, so that fluid is locked within the inner chambers 111 and 112, which maintains the inner partition in the extreme forward pitch position as shown. Because the full ahead pitch and throttle signals were applied slowly, there was sufficient time for the engine to respond, maintaining a desired control pressure which did not reach a critical overload pressure as will be described. During this sequence of movements the conical spring 42 in combination with air pressure in the bore 40 acted on the piston 41 and, in general, the combined force was sufficient to overcome moderate resistance to movement of the coupling link 60. The first and second outer partitions or overload pistons extend from the retracted position as shown to extended positions, shown in broken outline, when force from the control pressure on the control faces exceeds force of supply pressure acting on the projection end faces 109 and 110. If the overload pistons extend and a particular overload piston, e.g., 103, is contacted by the inner partition 100, the piston 103 would be forcibly retracted by the inner partition in a non- overload condition. Clearly, if a full reverse pitch signal were applied slowly the opposite situation would occur, with the output arm moving in direction of the arrow 45.

In summary, it can be seen that the apparatus 10 includes a signal receiving means, namely the forward and reverse pitch signal receiving means 13 and 14, which has a signal input means to receive a load demand signal from an operator, namely the input port 35, and a signal output means, namely the output rod assembly 24. The load control apparatus also includes the positioner apparatus 15 having positioner input means to receive the supply and control fluids, namely the supply ports 113 and 114, and the control ports 119 and 120. The positioner apparatus also has the positioner output means, namely the output arm 191, adapted to cooperate with loading means of the engine, namely the shaft 156. The positioner apparatus has partition means separating the supply and control fluids to permit interaction therebetween to control the positioner output means. The partition means include the inner partition or double-acting piston 100, and the first and second outer partitions or overload pistons 103 and 104. The hydraulic fluid valve means 16 is connected to the positioner output means, i.e., the arm 91, and to the signal output means i.e., the rod assembly 24, and cooperates therewith so as to be responsive to relative positions of both said output means. It can be seen that the partition means includes a plurality of partitions having at least two oppositely facing faces and being movable relative to each other. The faces are exposed to the supply fluid and control fluid so that, in an engine overload condition, forces generated on the faces act in opposition to each other to produce relative movement between the partitions.

The coupling link 60 serves as a linkage means interconnecting the signal output means to the positioner output means and to the valve means. The output rod assembly 24 provides a resilient interconnection for the linkage means to accommodate variation in speed of response between the signal output means and the positioner output means as will be described. It can be seen that the first output rod 32 is responsive directly to the input signal, that is movement of the diaphragm and plunger 37, whereas the second output rod 33 is mounted resiliently relative to the first output rod to provide the resilient connection which which can accommodate a relatively slow moving positioner apparatus, and is necessary to protect the apparatus in an overload situation, or when there is a hydraulic pressure failure as will be described.

It can be seen that the inner partition 100 is reciprocable relative to the body and has two oppositely facing supply faces 131 and 132 of equal effective area to each other. Each supply face is exposed to fluid in a respective supply fluid chamber, namely the inner chambers 111 and 112. Also outer partitions of the partition means have two oppositely facing control faces 147 and 148 of equal effective area to each other, the control faces being exposed to fluid in a respective control fluid chamber, namely the outer chambers 117 and 118. It can be seen that the partition means separate the supply and control fluids to permit interaction therebetween to control position of one of the partition means, i.e. the inner partition and this determines position of the positioner output means.

Figure 4

Figure 4:
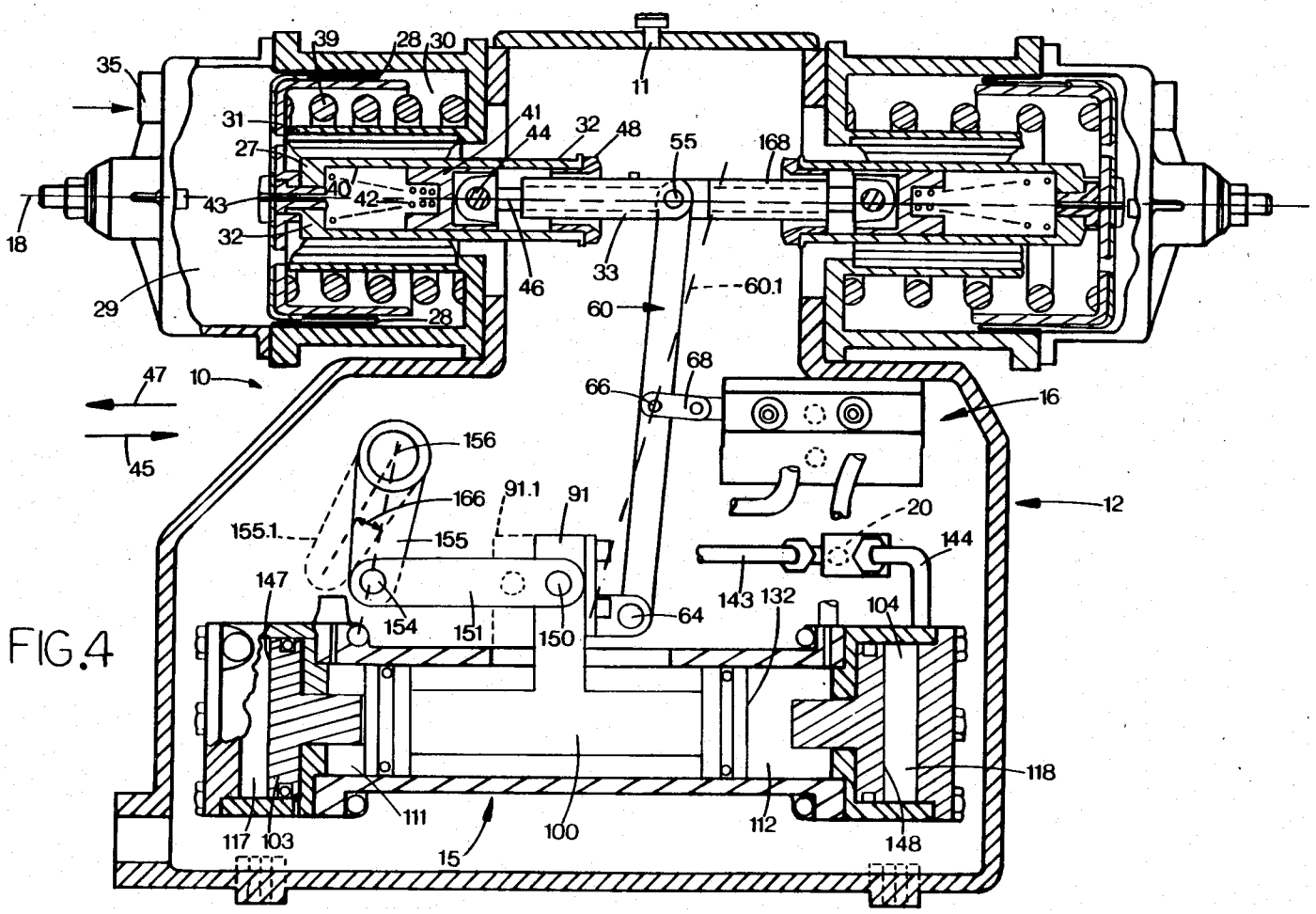
FIG. 4 is a simplified fragmented front elevation of the load control apparatus of FIG. 1, with the apparatus being shown in full outline with a full ahead demand signal applied, while concurrently subject to maximum overload compensation, some portions of the apparatus also being shown in broken outline reflecting a full ahead signal, without overload compensation.

In FIG. 4, a full forward pitch demand signal is shown applied to the signal receiving means 13, and the load on the engine is increased sufficiently to overload the engine. That is, the load is excessive for all conditions, or the load is applied to the engine before the engine has developed sufficient power to accommodate the load, and thus becomes overloaded. In this situation, the response of the apparatus or engine is such that the governor cannot maintain the desired RPM of the engine and generates a critical or overload signal which is a signal at a pressure in excess of the equilibrium pressure previously referred to. This sequence of events results in a modification, which is usually temporary, of the full pitch signal at the actual engine loading means as follows.

As shown in full outline, the plunger 37 is at a full limit of inwards movement in contact with the sleeve 31, but the piston 41 is not in contact with the sleeve 48 as will be explained. The coupling link 60 has moved per arrow 45, which in turn actuated the fluid valve means 16, so as to direct constant supply fluid into the second inner chamber 112 which shifted the inner partition means 100 in direction of the arrow 47. If the signal had been applied slowly, or if the engine was not overloaded, the overload pistons or first and second outer partitions 103 and 104 would remain in a retracted position as shown in FIG. 1, or would offer little resistance to permit the inner partition 100 to move to an extreme left hand position within the axial clearance opening 89. With no overload, the link 60, the output arm 91, and the loading arm 155 would attain full forward pitch positions shown in broken outline at 60.1, 91.1 and 155.1 respectively. However, the overload condition produces a critical control pressure within the outer chambers 117 and 118 which is higher than equilibrium pressure. This produces inwards forces on the first and second outer partitions greater than before, so that the two outer partitions move inwardly to extreme inner positions as shown and provide resistance to movement. The supply face 132 of the inner partition is exposed to fluid in the inner chamber 112 at the constant supply pressure which is less than twice the critical overload control pressure in the outer chambers 117 and 118. Because effective cross-sectional area of the supply face 132 is one half of the effective area of the control face 147, the force on the inner partition 100 in direction of the arrow 47 can be overcome by the force of the outer partition 103 acting on the inner partition in direction of the arrow 45. This causes the inner partition 100 to "back off" or move per arrow 45 to attain the position shown in full outline in FIG. 4 which moves the output arm 91 to the position shown in full outline in FIG. 4. Thus the output arm 91 and the link 60 moved from the positions 91.1 and 60.1 in broken outline, representing full forward pitch with no overload to the full outline positions 91 and 60 where full overload compensation is applied. This results in a corresponding swing of the loading arm 155 from the broken outline position 155.1 representing full reverse pitch, to a full outline position through an angle 166 representing a reduced forward pitch which eliminates the overload. This results in the pin 55 being moved closer to the means 13, per arrow 47, which moves the piston 41 as shown to compress the spring 42. This separates the piston 41 from the sleeve 48 as shown. Thus the resilient output rod assembly 24 accommodates the resulting inconsistency between the full forward pitch demand signal and the reduced forward pitch applied due to overload compensation. The projections 107 and 108 have a length which is sufficient to control movement of the inner piston or partition 100 to maintain an adequate load, even with full overload compensation, to provide sufficient pitch to permit the vessel to maneouver. Thus the overload pistons 103 and 104 interfere with respective dividing walls which serve as a limiter means to limit shifting of the inner partition by an amount which maintains adequate engine load. This results in the pin 55 being moved closer to the means 13, per arrow 47, which moves the piston 41 as shown to compress the spring 42. Thus the resilient output rod assembly 24 accommodates the resulting inconsistency between the full forward pitch demand signal and the reduced forward pitch actually applied due to overload compensation.

The above description relates to an increasing load condition applied to full forward pitch from no overload to a full overload configuration. Clearly, a similar result could be attained by applying a full ahead pitch demand signal sufficiently quickly so that the engine does not have chance to develop required power, and thus becomes overloaded due to a too rapid application of load. In this situation, the overload pistons would likely extend quickly and thus prevent the inner piston 100 from attaining the full ahead pitch position. The particular sequence of events would depend on the relative speeds of response. In either case it can be seen that the resilient output rod assembly 24 has been forced to a retracted condition as shown due to compression of the conical spring 42. This permits full extension of the first output rod 32 due to its rigid connection to the plunger 37, while the second output rod 33 and connecting rod 46 retract simultaneously to accommodate the position of the pin 55 which is controlled by the relative positions of the pins 64 and 66. From the "backed-off" or reduced pitch condition, if the engine speed can be increased or the load decreased, the control pressure will gradually decrease towards the equilibrium pressure i.e., below the critical overload pressure. This permits the inner partition 100 to move slowly per the arrow 47 as it overcomes force from the piston 103. Thus intermediate retracted positions of the overload piston 103 will be attained as the inner piston 100 gradually attains the full forward pitch condition by overcoming force from the overload piston.

Another situation that can be accommodated by the present invention is that of complete hydraulic pressure failure, which can occur with either failure of the supply pressure, the output pressure, or both. In any event, a full pitch demand signal, in either forward or reverse pitch, can be applied to the appropriate actuator, which can extend fully, moving the first output rod portion with it. The conical compression spring provides a resilient interconnection which permits the second output rod and the connecting rod to move inwardly, thus retracting the output rod assembly to retract to accommodate the position of the pin 55 which is controlled by the relative positions of the pins 64 and 66. If the supply pressure failed, there would be no force differential applied to the inner partition, and the load arm 155 or shaft 156 could be rotated manually by over-ride means operated manually, not shown. Clearly, if control pressure failed, there would be no movement of the overload pistons, and thus no compensation, but again the loading arm or engine load could be adjusted manually. In either an overload condition, or with hydraulic pressure failure, the resilient output rod protects components of the apparatus from damage because the rod 33 can also extend from the rod 46 by the pin 52 sliding in the slot 49. This is to accommodate extension of the output rod assembly when the respective plunger is retracted due to a low or zero pitch demand signal for that plunger.

ALTERNATIVES AND EQUIVALENTS

In the present apparatus, it can be seen that the position of the inner partition controls load on the engine, and the position of the inner partition is controlled by forces applied to end faces of the inner partition by the supply fluid, which are modified in an overload situation by a compensation force applied by an overload piston. The structural components can be inverted, or equivalents substituted to attain a similar situation where the position of a load control device i.e., the arms 91 or 155, is modified by an overload situation using selectively applied fluids at different pressures acting on pistons or equivalent movable partitions of particular area ratios within a positioner apparatus. In effect, the load output signal generated by the engine can be termed a first hydraulic control fluid at a variable control pressure which reflects the engine load, and the method is characterised by providing a second hydraulic fluid at a constant supply pressure. The method includes receiving a load demand signal from an operator, and actuating a fluid control valve in response to the load demand signal to direct one of the hydraulic fluids relative to a positioner apparatus. The remaining hydraulic fluid is admitted into the positioner apparatus, wherein the fluids are separated, but interaction is permitted between the fluids to generate a positioner output signal. The output signal is transmitted simultaneously to means controlling load on the engine, and to the fluid control valve to reflect disposition of means controlling load on the engine. Thus, there is a feedback signal to the load control valve, and to the demand signal output means which interact to modify the valve position as required. The method also includes providing in the positioner apparatus movable partition means having supply and control faces disposed to face in opposite directions. The method includes admitting the control fluid and the supply fluid into the positioner apparatus in such a manner as to act in opposition to each other on the partition means so that the partition means separate the fluids from each other. The purpose of the invention is to maintain the control pressure at a particular equilibrium pressure which reflects a desired engine load for a particular engine. The method includes permitting the control fluid and the supply fluid to act on the partition means in such a manner that effective area of the control face to effective area of the supply face is approximately equal to the ratio of supply pressure to equilibrium pressure. In this way at a desired engine load, force of the supply fluid can be balanced by force of the control fluid at equilibrium pressure so as to maintain the desired engine load. In an overload situation, relative movement is permitted between the control and supply faces so that when net force of the control pressure acting on one of the control faces exceeds net force of the supply pressure acting on one of the supply faces, load on the engine is reduced until the equilibrium pressure is again attained.

I claim:

1. An apparatus for controlling a load imposed on an engine, the apparatus including:

(a) signal receiving means having a signal input means to receive a load demand signal from an operator, and a signal output means, (b) a positioner apparatus having positioner input means to receive hydraulic supply fluid and hydraulic control fluid, the supply fluid being at an essentially constant supply pressure, and the control fluid being at a variable control pressure reflecting engine load, the positioner apparatus having a positioner output means adapted to cooperate with loading means of the engine; the positioner apparatus also having partition means separating the supply and control fluids, the partition means having a plurality of partitions having at least two oppositely facing faces and being movable relative to each other, the faces being exposed to the supply and control fluids, so that, in an engine overload condition, forces generated on the faces act in opposition to each other to produce relative movement between the partitions to control the positioner output means, (c) hydraulic fluid valve means to control flow of hydraulic fluid relative to the positioner apparatus, the valve means cooperating with the positioner output means and the signal output means as to be responsive to relative position of both said output means.

2. An apparatus as claimed in claim 1 in which the positioner apparatus is further characterized by:

(a) a fixed positioner cylinder body, the partition means being mounted within the cylinder body so as to be reciprocable relative thereto, (b) the partition means having a plurality of partitions, and the positioner output means cooperating with at least one of the partitions to reflect relative position between the said one partition and the cylinder body.

3. An apparatus as claimed in claim 1 in which the positioner apparatus is further characterized by:

(a) a positioner cylinder having a positioner cylinder body having an inner cylinder with an inner bore, and first and second spaced apart outer cylinders at opposite ends of and aligned with the inner cylinder, the outer cylinders having respective outer bores which are larger than the inner bore and are closed at respective outer ends, (b) the partition means also including an inner partition mounted for reciprocable movement within the inner cylinder, and first and second outer partitions provided on opposite sides of the inner partition, each outer partition being mounted for reciprocable movement within a respective outer cylinder, each outer partition being adapted to cooperate with the inner partition when a particular outer partition is extended to be closely adjacent the inner partition, so as to move the inner partition to reflect at least a portion of inward movement of the said particular outer partition, (c) first and second inner chambers positioned between outer ends of the inner partition and the first and second outer partitions respectively, the inner chambers having supply fluid ports to receive and discharge the supply fluid as required, (d) first and second outer chambers positioned between the respective outer partition and the outer ends of the respective outer cylinder, each outer chamber having a respective control fluid port adapted to receive and discharge the control fluid as required, (e) the positioner output means cooperating with the inner partition to reflect position of the inner partition relative to the positioner cylinder body.

4. An apparatus as claimed in claim 3 in which the variable control pressure of the control fluid can attain a particular equilibrium pressure which reflects a desired engine load for a particular engine, and the positioner apparatus is further characterized in that:

(a) ratio of the bore of the outer cylinder to the bore of the inner cylinder is approximately equal to ratio of the supply pressure to the equilibrium pressure, so that force of the supply fluid at supply pressure acting on the inner partition can be balanced by force of the control fluid at equilibrium pressure acting on one of the outer partitions.

5. An apparatus is claimed in claim 3 in which the positioner apparatus is further characterized by:

(a) first and second dividing walls located at outer ends of the inner cylinder to divide respective outer cylinders from adjacent respective ends of the inner cylinder, each dividing wall having a dividing opening therein, (b) each outer partition has a respective inwardly facing axially aligned projection, each projection being a sliding sealed fit within a respective dividing opening in the respective dividing wall, the projections being adapted to contact the inner partition when the outer partitions are extended inwardly and the inner partition approaches an extreme outer position within the inner chamber, so that the inward axial movement of the outer partition moves or limits movement of the inner partition.

6. An apparatus as claimed in claim 3 further characterized in that:

(a) the positioner cylinder body is fixed and has a clearance means to receive the positioner output means and to permit axial movement of the positioner output means, (b) the positioner output means extends outwardly from the inner partition to pass through the clearance means.

7. An apparatus as claimed in claim 3 further characterized in that:

(a) the fluid valve means has a valve body having a valve input port to receive the supply fluid, and first and second valve ports communicating with the supply ports of the first and second inner chambers respectively, (b) the valve means has a valve member which is mounted for movement relative to the valve body so as to direct supply fluid to the respective inner chamber as required.

8. An apparatus as claimed in claim 1 further characterized in that:

(a) the positioner apparatus has a fixed cylinder body and the positioner input means has at least two fluid ports cooperating with the body to receive and discharge fluid as required, (b) the fluid valve means has a fixed valve body having a valve input port to receive the supply fluid and first and second valve ports communicating with the two fluid ports of the positioner input means, (c) the valve means has a valve member mounted for movement relative to the valve body in response to corresponding movement of a movable portion of the signal receiving means, so as to direct supply fluid to the positioner apparatus as required.

9. An apparatus as claimed in claim 8 further characterized in that:

(a) the signal receiving means has a body that is fixed relative to the cylinder body of the positioner apparatus, and the signal output means moves generally axially relative to the body of the signal receiving means, (b) the movable valve member is a valve spool mounted for axial movement parallel to the general axial movement of the signal output means, and the valve body has a spool bore to receive the valve spool therein, the spool bore communicating with the valve input port to receive the supply fluid, and with the first and second ports to discharge and receive the supply fluid, and with an exhaust valve port to discharge supply fluid as required, (c) the positioner cylinder body is fixed and has a clearance means to receive the positioner output means and to permit axial movement of the positioner output means, and in a direction parallel to axial movement of the signal output means, the positioner output means extends outwardly from the inner partition to pass through the clearance means.

10. An apparatus as claimed in claim 1 further characterized by:

(a) linkage means interconnecting the signal output means to the positioner output means and to the valve means, the linkage means having a resilient inter-connection to accommodate variation in speed of response between the signal output means and the positioner output means.

11. An apparatus as claimed in claim 10 further characterized in that:

(a) the signal output means has first and second output rods, the first output rod being responsive directly to the input signal, and the second output rod being mounted resiliently relative to the first output rod to provide the resilient interconnection, (b) the linkage means is a rigid coupling link interconnected to the second output rod and the positioner output means, (c) a movable portion of the valve means is connected to the rigid link so that the valve means is responsive to movement of the second output rod and the positioner output means.

12. An apparatus as claimed in claim 10 further characterized in that:

(a) the first and second output rods are telescopically mounted relative to each other, (b) the resilient inter-connection is a spring means cooperating with the two output rods to apply an axial force relative to the two output rods.

13. A positioner apparatus for use with a load control apparatus for controlling a load on an engine, the positioner apparatus having:

(a) a positioner cylinder body having two spaced supply fluid chambers, each supply fluid chamber having a respective supply fluid port to receive hydraulic supply fluid at an essentially constant supply pressure, and to discharge the supply fluid, the body also having two spaced control fluid chambers, each control fluid chamber having a respective control fluid port to receive hydraulic control fluid at a variable control pressure reflecting engine load, and to discharge the control fluid, (b) partition means reciprocable relative to the body, the partition means having two oppositely facing supply faces to equal effective area to each other, each supply face being exposed to supply fluid in a respective supply fluid chamber, the partition means also having two oppositely facing control faces of equal effective area to each other, the control faces being exposed to control fluid in a respective control fluid chamber, the partition means separating the supply and control fluids to permit interaction therebetween, so that in an engine overload condition, forces generated on one supply face and on one control face act in opposition to each other to produce relative movement between the partition means so as to control position of the partition means, (c) positioner output means cooperating with the partition means to reflect position of the partition means within the positioner cylinder, the positioner output means also being adapted to cooperate with loading means of the engine.

14. An apparatus as claimed in claim 13 in which the variable control pressure of the control fluid can attain a particular equilibrium pressure which reflects a desired engine load for a particular engine, and the positioner apparatus is further characterized in that:

(a) ratio of the area of one control face to area of one supply face is approximately equal to ratio of the supply pressure to the equilibrium pressure, so that force of the supply fluid at supply pressure acting on one supply face can be balanced by force of the control fluid at equilibrium pressure acting on one control face.

15. An apparatus as claimed in claim 13 further characterized in that:

(a) the positioner cylinder body has an inner cylinder with an inner bore, and first and second spaced apart outer cylinders at opposite ends of and aligned with the inner cylinder, the outer cylinders having respective outer bores which are larger than the inner bore and are closed at respective outer ends, (b) the partition means includes an inner partition having the supply faces at opposite ends thereof and being mounted for reciprocable movement within the inner cylinder, and first and second spaced outer partitions provided on opposite sides of the inner partition, each outer partition having a respective control face and being mounted for reciprocable movement within a respective outer cylinder, the outer partitions being adapted to cooperate with the inner partition when a particular outer partition is adjacent the inner partition, so as to control limited movement of the inner partition to reflect at least a portion of the inward movement of the said particular outer partition, (c) the supply fluid chambers are first and second inner chambers located within the inner cylinder and positioned between outer ends of the inner partition and the first and second outer partitions respectively, each inner chamber having a respective supply fluid port to receive and discharge supply fluid, (d) the control fluid chambers are first and second outer chambers positioned between the respective outer partition and an adjacent outer end of the respective outer cylinder, each outer chamber having a respective control fluid port adapted to receive and discharge the control fluid, (e) the positioner output means cooperates with the inner partition so as to reflect position of the inner partition relative to the positioner cylinder body.

16. An apparatus as claimed in claim 15 in which the positioner apparatus is further characterized by:

(a) first and second dividing walls located at outer ends of the inner cylinder to divide respective outer cylinders from adjacent respective inner cylinders, each dividing wall having a dividing opening therein;

(b) each outer partition has a respective inwardly facing axially aligned projection, each projection being a sliding sealed fit within a respective dividing opening in the respective dividing wall, the projections being adapted to contact the inner partition when the outer partitions are extended inwardly and the inner partition approaches an extreme outer position within the inner chamber, so that the inward axial movement of the outer partition moves or limits movement of the inner partition.

17. An apparatus as claimed in claim 15 further characterized by:

(a) limiter means adapted to limit shifting of the inner partition means by the outer partition means by an amount sufficient to maintain adequate load on the engine when a maximum overload condition is attained.

18. An apparatus as claimed in claim 17 in which the limiter means is characterized by:

(a) first and second dividing walls located at outer ends of the inner cylinder to divide respective outer cylinders from respective adjacent inner cylinders, each dividing wall having a dividing opening therein, (b) each outer partition has a respective inwardly facing axially aligned projection, each projection being a sliding sealed fit within a respective dividing opening in the respective dividing wall, the projections being adapted to contact the inner partition when the outer partitions are extended inwardly and the inner partition approaches an extreme outer position within the inner chamber, so that inward axial movement of the outer partition moves or limits movement of the inner partition.

19. A method of controlling load on an engine including the steps of:

(a) subjecting the engine to a load, (b) providing as a load output signal a first hydraulic control fluid at a variable control pressure which reflects the engine load, (c) providing a second hydraulic control fluid at a constant supply pressure, (d) receiving a load demand signal from an operator, (e) actuating a fluid control valve in response to the load demand signal to direct one of the hydraulic fluids relative to a positioner aaparatus, (f) admitting into the positioner apparatus the remaining hydraulic fluid, (g) providing in the positioner apparatus moveable partitions having at least two oppositely facing faces to separate the control fluid from the supply fluid for permitting interaction therebetween by exposing the oppositely facing faces of the partitions to the fluids, (h) in an engine overload condition, generating forces on the two oppositely facing faces of the partitions in opposition to each other, to produce relative movement between the partition means, so as to generate a positioner output signal, (i) transmitting the output simultaneously to means controlling load on the engine, and to the control fluid valve to reflect disposition of the means controlling load on the engine, so as to vary flow of one of the fluids into the positioner apparatus.

20. A method as claimed in claim 19 in which the variable control pressure of the control fluid can attain a particular equilibrium pressure which reflects a desired engine load for a particular engine, and the method is further characterized by:

(a) providing in the positioner apparatus movable partition means having supply and control faces disposed to face in opposite directions, (b) admitting the control fluid and the supply fluid into the positioner apparatus in such a manner as to act in opposition to each other on the partition means so that the partition means separates the fluids from each other, (c) permitting the control fluid and the supply fluid to act on the partition means in such a manner that effective area of the control face to effective area of the supply face is approximately equal to the ratio of supply pressure to equilibrium pressure so that force of the supply fluid can be balanced by force of the control fluid at equilibrium pressure, so as to maintain desired engine load.

21. A method as claimed in claim 20 further characterized by:

(a) permitting relative movement between the control and supply faces in response to force acting thereon;

(b) detecting relative movement when net force of the control pressure acting on the control face exceeds net force of the supply pressure acting on the supply face, (c) using the relative movement to reduce load on the engine

22. A method as claimed in claim 21 further characterized by:

(a) maintaining adequate load on the engine to ensure manoeuvrability of vessel.

23. A method as claimed in claim 20 further characterized by:

(a) providing on the movable partition means two oppositely facing supply faces, and two oppositely facing control faces, (b) conducting the control fluid to expose the control faces to the control fluid at two spaced locations, (c) conducting the supply fluid so as to expose the supply faces to the supply fluid at two spaced locations, (d) permitting relative movement between the control and supply faces in response to force acting thereon (e) detecting relative movement when net force of the control pressure acting on one of the control faces exceeds net force of the supply pressure acting on one of the supply faces, which is then used to reduce load on the engine.

* * * * *